US006119283A

United States Patent [19]

Galler

[11] Patent Number: 6,119,283

[45] Date of Patent: Sep. 19, 2000

[54] METHOD AND APPARATUS FOR EVACUATION OF LIQUIDS

[75] Inventor: Lothar Galler, Hammersbach, Germany

[73] Assignee: Roediger Vakuum- und Haustechnik GmbH, Germany

[21] Appl. No.: 08/927,054

[22] Filed: Sep. 10, 1997

[30] Foreign Application Priority Data

Sep. 13, 1996 [DE] Germany ..... 296 16 003 U

[51] Int. Cl.[7] ..... E03D 11/00

[52] U.S. Cl. ..... 4/431; 4/434; 4/653; 4/668; 4/688; 137/488; 137/907; 251/29

[58] Field of Search ..... 4/302, 431, 434, 4/653, 668, 679, 688; 137/488, 489.5, 907; 251/29

[56] References Cited

U.S. PATENT DOCUMENTS

| | | | |
|---|---|---|---|
| 2,543,846 | 3/1951 | Griswold | 137/488 |
| 5,570,715 | 11/1996 | Featheringill et al. | 137/907 X |
| 5,588,458 | 12/1996 | Ushitora et al. | 137/907 X |

*Primary Examiner*—Robert M. Fetsuga

*Attorney, Agent, or Firm*—Ansel M. Schwartz

[57] ABSTRACT

A method and apparatus for evacuation of liquids, such as wastewater from e.g. wash basins, urinals, bath tubs or showers, whereby the liquid is collected in a sump, generates a hydrostatic pressure and is evacuated from the sump through a vacuum pipeline after a predetermined hydrostatic pressure is generated. In order to avoid flexible control conduits and to achieve time controlled evacuation with a simple mechanism, valves are integrated in a housing and operated by pressure differences acting on diaphragms after a certain hydrostatic pressure has been generated. One of the valves opens a connection between the sump and the vacuum pipeline to evacuate the liquid.

30 Claims, 8 Drawing Sheets

METHOD AND APPARATUS FOR EVACUATION OF LIQUIDS

FIELD OF THE INVENTION

The present invention is related to the evacuation of liquids. More specifically, the present invention is related to the evacuation of liquids, such as wastewater from e.g. wash basins, urinals, bath tubs or showers, which is collected in a sump, generates hydrostatically an air pressure and is evacuated from the sump into a vacuum pipeline after a predetermined hydrostatic pressure is generated, whereby the hydrostatic pressure acts on a sensor diaphragm operating a first valve which admits atmospheric pressure into a first chamber located adjacent to a control diaphragm, whereby the control diaphragm operates a second valve which in turn operates a third valve closing or opening a connection between the sump and the vacuum pipeline.

BACKGROUND OF THE INVENTION

Devices for the evacuation of liquids are used for example in combination with vacuum sewerage systems in boats, airplanes or trains to evacuate liquids by use of vacuum, whereby the sump, collecting the liquid, and a control mechanism are separated from each other and connected through flexible control conduits. If control conduits are damaged, evacuation of the liquid is no longer possible. Devices according to prior art are complicated and so large that they cannot be reasonably installed underneath sanitary appliances replacing conventional water syphons.

The present invention addresses these problems and provides a mechanism of the initially mentioned kind, which guarantees reliable evacuation of liquid collected in the sump by means of simple constructive elements, without requiring flexible conduits to external control devices. In addition, the mechanism shall be so compact that they can be easily installed underneath a wash basin, a urinal, a bath tub or a shower tub replacing conventional water syphons.

SUMMARY OF THE INVENTION

According to the present invention, the problems are solved by means that the sensor diaphragm, the first valve, the control diaphragm, the second valve and the third valve are integrated in a common housing, that a valve piston of the third valve is connected with the housing by means of an actuating diaphragm separating a second chamber from a third chamber, whereby the third chamber is separated from the sump by the third valve in its closed position, and whereby the second chamber can be connected to atmospheric pressure or vacuum through the second valve.

The present invention provides a very compact evacuation means which can be installed directly underneath a wash basin or a urinal, or in the drain pipe of a bath or shower tub or any other sanitary appliance wherefrom liquid is to be evacuated by vacuum. The unit is preferably shaped such that it can be used to replace conventional water syphons. Therefore, wash basins, urinals or other sanitary appliances evacuated by vacuum can look similar to those connected to conventional gravity drain pipelines.

No control conduit is required outside of the housing because all elements required for evacuation of the liquid and for controlling the evacuation procedure are integrated in a common housing, wherein the sump with a bottom, an orifice in the bottom and the third valve closing the orifice are located.

In a preferred embodiment, the first and/or the second and/or the third valve, or its valve pistons, are movably arranged along a common axis. This guarantees simple construction of the means.

In a more preferred embodiment, the sump is connected with a fourth chamber, located adjacent to the sensor diaphragm, through an opening underneath a wall in the sump, ending distant from the bottom of the sump such that hydrostatic pressure at the bottom of the sump is transmitted through a conduit to the fourth chamber and the sensor diaphragm. A ring slot or ring chamber preferably encompasses the sump, is separated from the sump by the wall, and is connected with the sump through the opening underneath the wall. The conduit between the sump and the fourth chamber, transmitting hydrostatically generated air pressure to the sensor diaphragm, is located within the housing in order to make the evacuation means compact and simple.

In an even more preferred embodiment, the sensor diaphragm separates the fourth chamber, into which hydrostatic pressure is transmitted, from a fifth chamber which is connected to the atmosphere. The fifth chamber is also connectable through the first valve to the first chamber located adjacent to the control diaphragm. Atmospheric pressure is transmitted from the fifth chamber to the first chamber while the first valve is open. When the hydrostatic pressure in the fifth chamber has dropped, the first valve is closed, the first chamber is evacuated through the vacuum line and the pressure in the first chamber decreases.

In an even more preferred embodiment, a throttling element is disposed between the first chamber and the vacuum line to reduce evacuation velocity and to delay the pressure decrease within the first chamber in order to delay closing of the third valve until the liquid collected in the sump is completely evacuated through the third valve into the vacuum pipeline. The pressure in the first chamber, acting on the control diaphragm, can decrease only after the hydrostatic pressure acting on the sensor diaphragm has dropped and the first valve extending from the sensor diaphragm has closed the connection between the first chamber and the atmosphere.

In an even more preferred embodiment, a sixth chamber which is separated from the first chamber by the control diaphragm, is connected with the vacuum line and connectable through the second valve with the second chamber adjacent to the actuating diaphragm.

The third valve, opening or closing an orifice between the sump and the vacuum line, is preferably spring loaded in the closing direction.

The third valve comprises a cylinder-shaped section encompassing a piston-shaped section of the housing, whereby the control diaphragm extends between the cylinder-shaped section and the housing. This guarantees a simple guidance of the third valve. A spring may be located between the piston-shaped section of the housing and a lower surface of a valve disc of the third valve. The spring presses the valve disk against a valve seat closing the orifice between the sump and the vacuum line.

Not only the third valve, but also the first and second valves are spring loaded in order to open or close, depending on the pressure differences between the chambers separated by diaphragms which are connected with the first, second and third valves.

The third valve is opened against the spring load when wastewater has been collected in the sump and the second and third chamber have been connected with the vacuum line and evacuated. The second chamber can be evacuated only while the second valve closes the connection between the second chamber and the atmosphere. This is the case if sufficiently strong hydrostatic pressure acts on the sensor diaphragm to operate the first valve and open a connection between the atmosphere and the first chamber which is located adjacent to the control diaphragm.

The sixth chamber, which is located adjacent to the control diaphragm and wherein a piston of the second valve is movable, is connected with the vacuum line, independent of the position of the second valve. However, whether vacuum can be transmitted to the second chamber, located adjacent to the actuating diaphragm, depends on the position of the second valve.

Though the sump is preferably located within the housing wherein the first, second and third valves as well as the sensor, control and switch diaphragms are located, the sump may also be located separate from the housing and connected through a preferably rigid connection to the orifice which is closable by the third valve, whereby a conduit, such as a bore, transmits hydrostatic pressure from the connection to the sensor diaphragm.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 9:
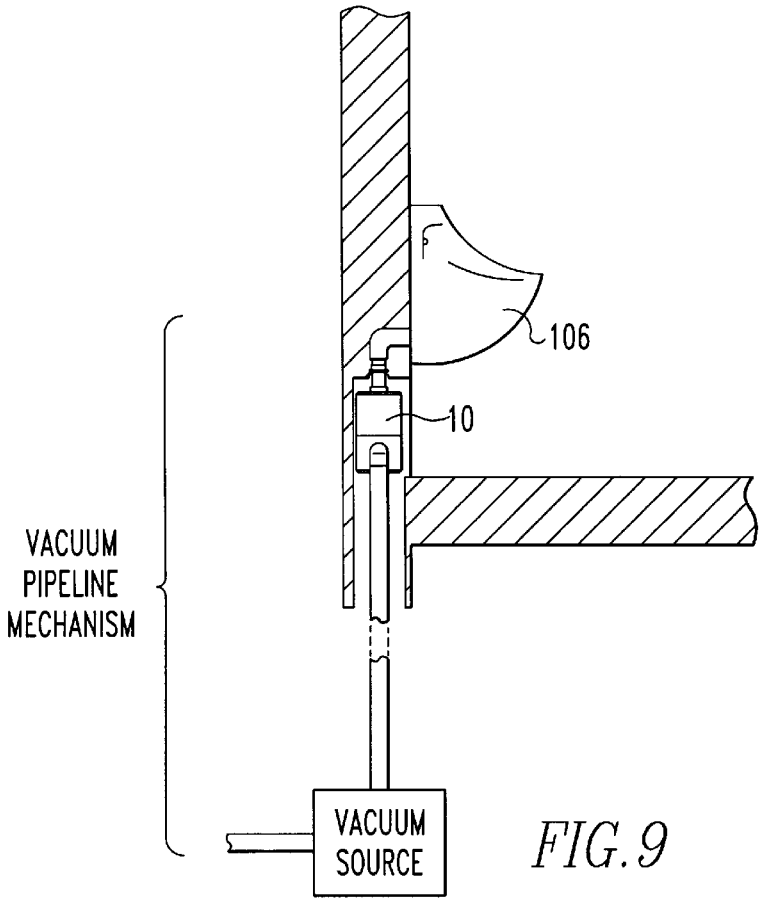
FIG. 9 is a schematic representation of a urinal equipped with an apparatus according to the present invention.

Referring now to the drawings wherein like reference numerals refer to similar or identical parts throughout the several views, and more specifically to FIGS. 1–6 thereof, there is shown an apparatus 10 for collection and evacuation of liquid by means of vacuum. The apparatus 10 comprises a cylindrical housing 12 wherein liquid which has entered through an orifice 14 is collected in a pot-shaped sump 16. The sump 16 comprises a bottom 26 and an orifice 18 at the bottom 26. An edge of the orifice 18 forms a valve seat for a valve 20 which is hereafter addressed as the third valve. While the third valve 20 is open, liquid can be evacuated through the orifice 18 into a vacuum pipeline 22. The vacuum pipeline 22 is preferably connected to a vacuum source, as is well known in the art, and together form a vacuum pipeline mechanism, as shown in FIG. 9.

A circumferential wall 24 is provided within the sump 16 and ends distant from the bottom 26 of the sump 16 and separates a ring chamber 28 encompassing the sump 16. A bore 30 within the housing 12 connects the ring chamber 28 at a level above the lower end of the wall 24 such that liquid collected in the sump 16 cannot enter the bore 30, but hydrostatically generates an air pressure within the ring chamber 28.

Besides the third valve 20, a first valve 32 and a second valve 34 are coaxially arranged above each other within the housing 12. A sensor diaphragm 36, a control diaphragm 38 and an actuating diaphragm 40 interacting with the first, second and third valves 32, 34, 20 are arranged above each other within the housing 12 such that they are circumferentially fixed to the housing 12 and centrally connected with pistons 42, 44 and 46 of the first, second and third valves 32, 34 and 20. The valve pistons 42, 44, 46 extend from the centers of the respective diaphragms 36, 38, 40 or penetrate them (as the piston 46 of the third valve 20).

The piston 42 of the first valve 32 penetrates a bore 50 within a first separation wall 52 of the housing 12 forming a ring slot. The sensor diaphragm 36 is located on one side of the separating wall 52, the control diaphragm 38 is located on the other side. The control diaphragm 38 is either lying on the separating wall 52 (see FIGS. 1 and 2) or is lifted from the separating wall (see FIGS. 3 to 5), depending on pressure conditions to be described later.

While the first valve 32 is closed, the bore 50 is sealed by a seal 54, which might be a hat seal. When the sensor diaphragm 36, the valve piston 42 and the seal 54 are lifted, the bore 50 and therewith the first valve 32 are opened (see FIGS. 2 to 4).

A spring 56 encompasses the piston 42 and interacts with the sensor diaphragm 36. The spring 56 is supported by the center of the sensor diaphragm 36 and the first separating wall 52 and is centered by encompassing a cylindrical projection 58 of the separating wall 52. The spring 56 exerts a permanent force on the sensor diaphragm 36 and drives it in the direction of a bottom wall 60 of the housing 12 in order to close the first valve 32 by pressing the seal 54 on the bore 50.

The sensor diaphragm 36 separates a chamber 62, into which hydrostatic pressure can be transmitted from the ring chamber 28 through the bore 30, from another chamber 64, which is connected to the atmosphere trough a bore 76 and an opening 68 of the housing 12.

Another spring 66 drives the control diaphragm 38 towards the first separating wall 52. The spring 66 encompasses the piston 44 of the second valve 34 and is centered by a insert piece 48 which comprises steps and is located in an orifice 70 within a second separating wall 84. The insert piece 48 comprises a bore 72 wherethrough the piston 44 of the second valve 34 penetrates forming a ring slot.

Depending on the positions of the sensor diaphragm 38 and the projecting piston 44, a valve disc 74 of the piston 44 closes either the bore 72 or a connection 77 to the opening 68 and the atmosphere.

The control diaphragm 38 separates a chamber 78, which is located adjacent to the first separating wall 52 and is connectable through a bore 50 and the first valve 32 with the chamber 64, from a chamber 80, which is connected through a conduit 82 with the vacuum pipeline 22. The chamber 80 is confined by the second separating wall 84 on the side opposite to the control diaphragm 38. The second separating wall 84 separates the chamber 80 from another chamber 86 which is confined by the actuating diaphragm 40 on the opposite side. The actuating diaphragm 40 is circumferentially clamped to the housing 12 and centrally clamped to the piston 46 of the third valve 20. The piston 46 is shaped like a cylinder hat and encompasses a section 88 projecting from the separating wall 84 in the direction to the sump 16, this section 88 being shaped like a piston and encompassing a spring 90. The spring 90 interacts with a disk-shaped section 92 of the piston 46 and drives the disk 92 towards the orifice 18 of the sump 16 to close the orifice 18. Alternatively, vacuum transmitted from the vacuum pipeline 22 to the upper surface of the actuating diaphragm 40 may be sufficient to lift the disk 92 and close the orifice 18.

The actuating diaphragm 40 separates the chamber 86 from a chamber 94 which is located in the direction of the sump 16. The chamber 94 connects the sump 16 with the vacuum pipeline 22 while the third valve 20 is open. Depending on the position of the piston 44 of the second valve 32, the chamber 86 is connected through a bore 96 either with the bore 76, the opening 68 and the atmosphere, or with the chamber 80, the conduit 82 and the vacuum pipeline 22.

The function of the apparatus 10 according to the present invention is described hereafter.

When liquid is collected in the sump 16 while the orifice 18 is closed, air enclosed in the ring chamber 28 is compressed by hydrostatic pressure. The hydrostatically generated air pressure is transmitted from the ring chamber 28 through the bore 30 to the chamber 62 which is addressed as fourth chamber. As soon as a hydrostatic pressure is generated which is sufficient to overcome the force exerted on the sensor diaphragm 36 by the spring 56, the sensor diaphragm 36 is lifted and the first valve 32 is opened (see FIG. 2). Atmospheric pressure is now transmitted through the opening 68, the fifth chamber 64 and the open first valve 32 to the chamber 78, which is located between the control diaphragm 38 and the first separating wall 52 and hereafter addressed as first chamber and connected via a conduit 100, comprising a throttling element 98, to the chamber 80, which is located on the opposite side of the control diaphragm 38 and is hereafter addressed as sixth chamber, and therewith through conduit 82 to the vacuum pipeline 22.

Figure 1:
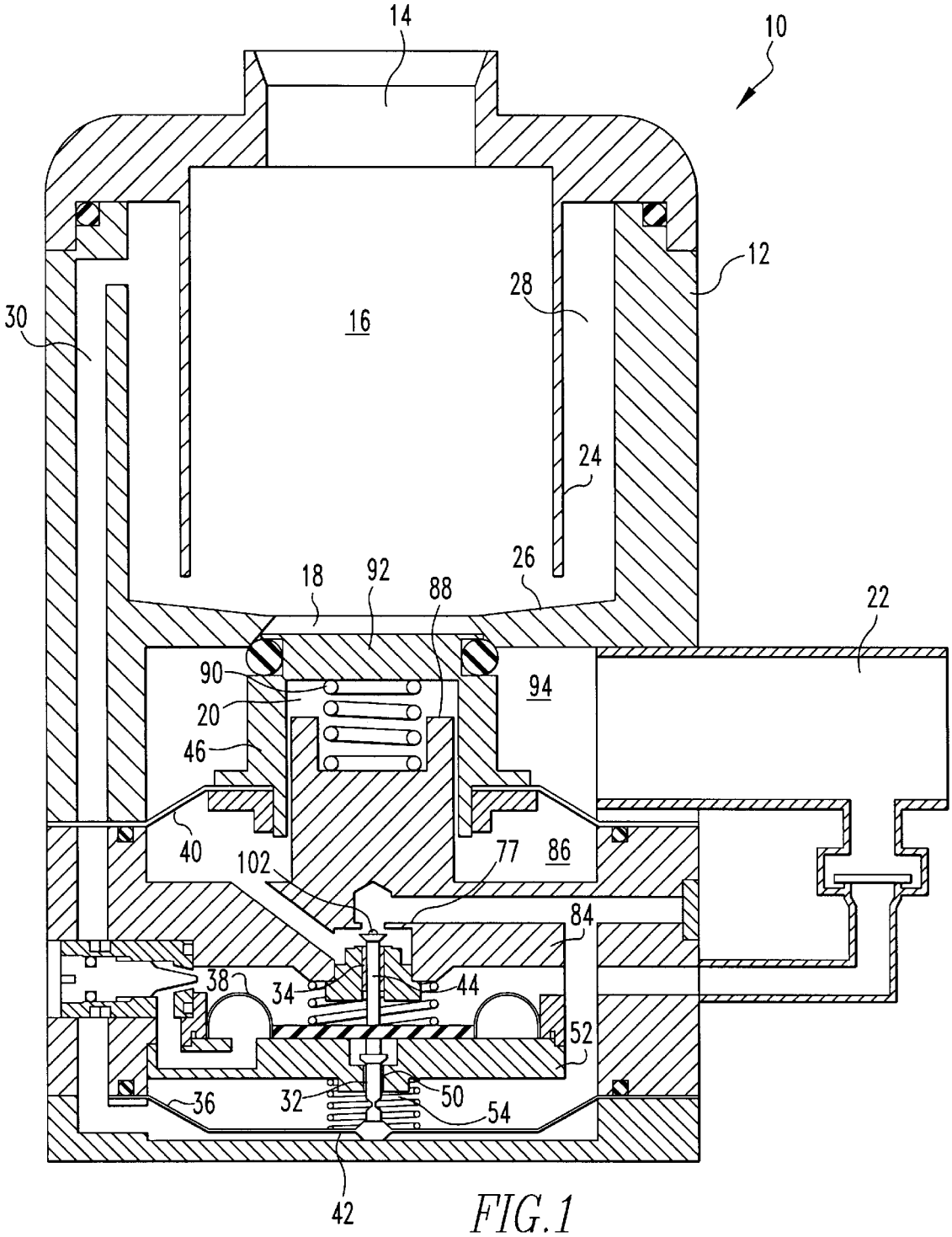
FIG. 1 is a sectional view of an apparatus for evacuation of liquids with an empty sump according to the present invention.
Figure 2:
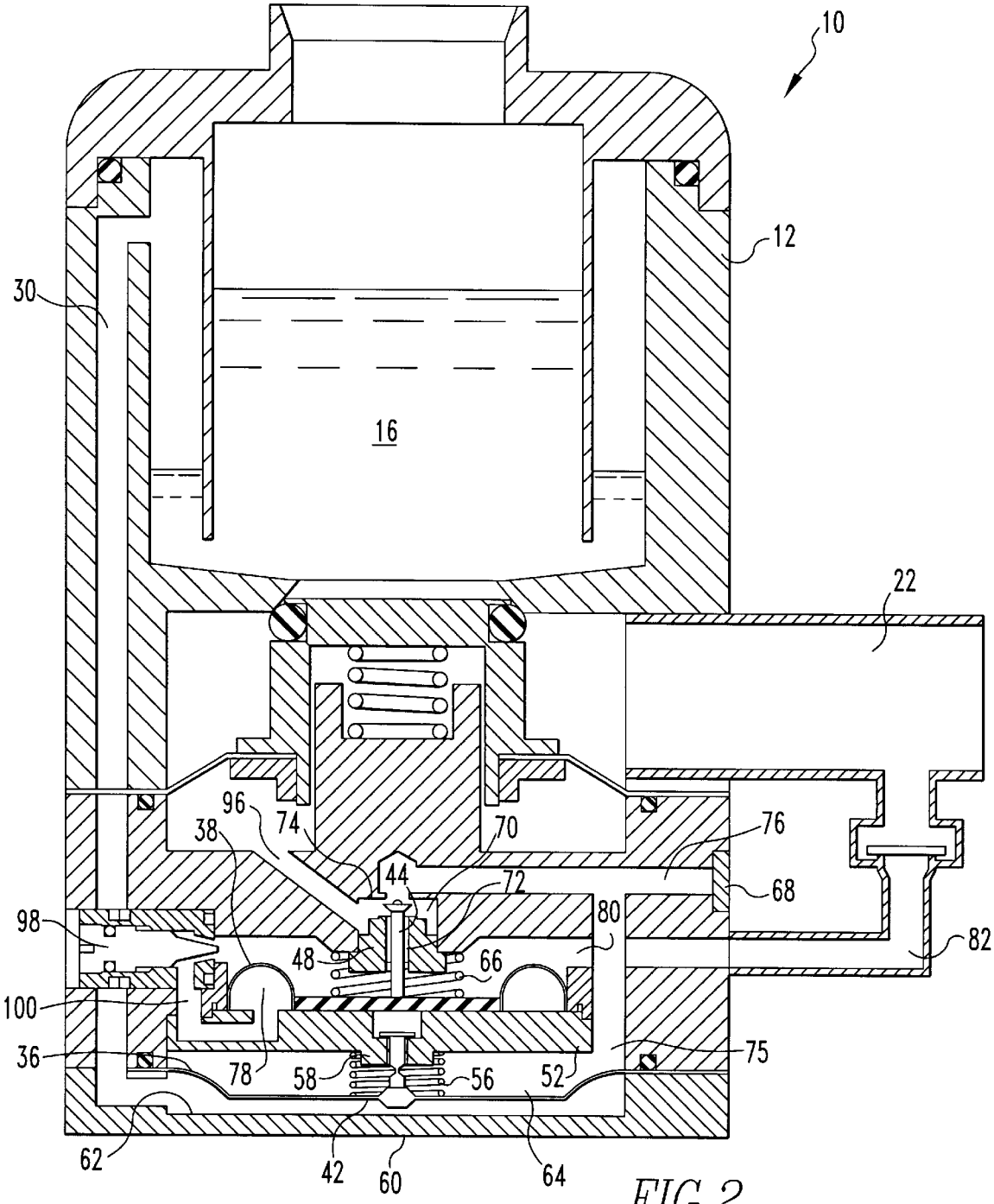
FIG. 2 is a schematic representation of the apparatus according to FIG. 1 after liquid has been collected in the sump and hydrostatically generates air pressure.
Figure 3:
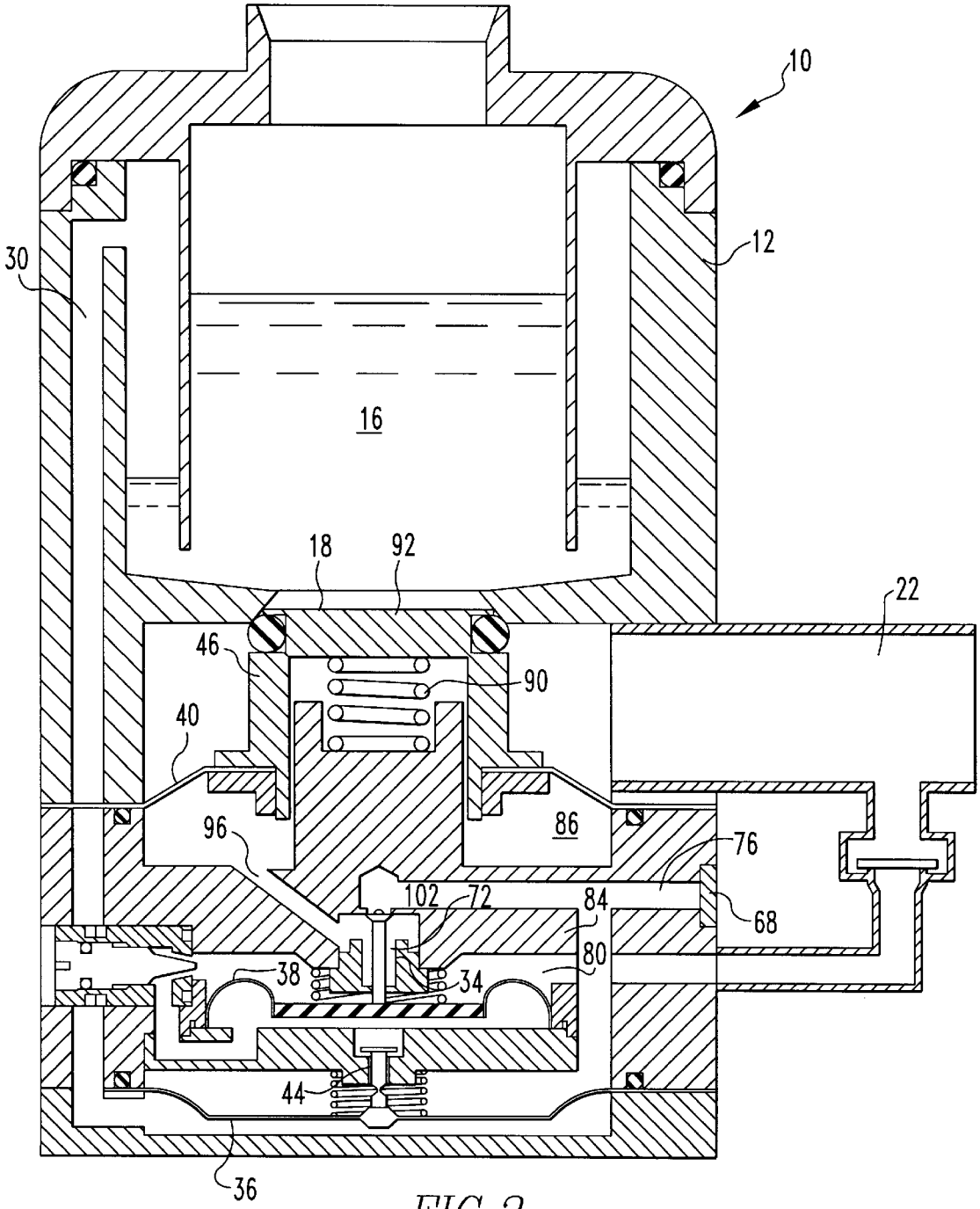
FIG. 3 is a schematic representation of the apparatus according to FIGS. 1 and 2 after a first valve has been opened by the hydrostatically generated air pressure and a second valve has been switched from a first to a second position.
Figure 4:
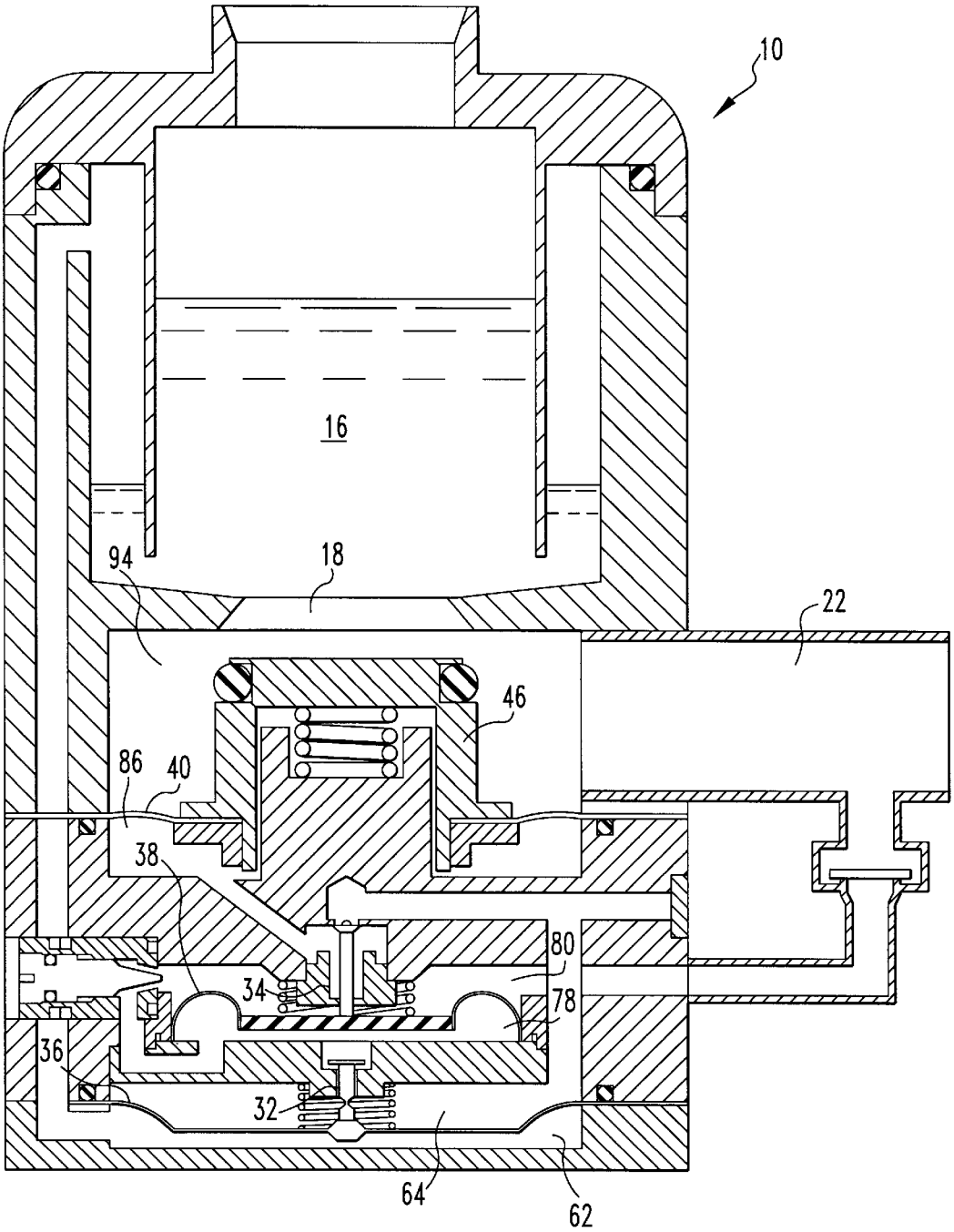
FIG. 4 is a schematic representation of the apparatus according to FIGS. 1 to 3 while the liquid is evacuated after a control diaphragm is lifted and a third valve has been opened.
Figure 5:
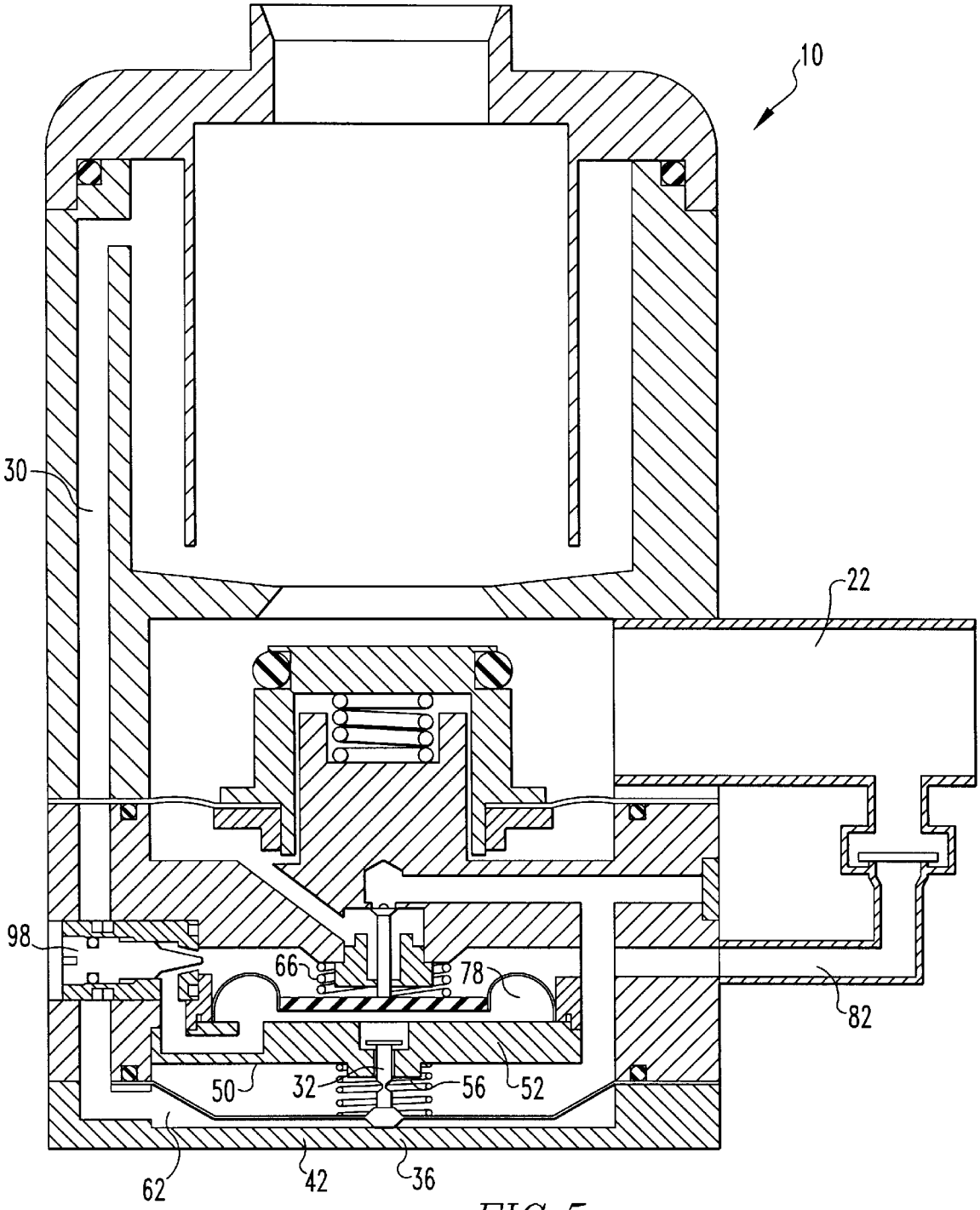
FIG. 5 is a schematic representation of the apparatus according to FIGS. 1 to 4 after the hydrostatically generated air pressure has been released and the first valve has been closed.
Figure 6:
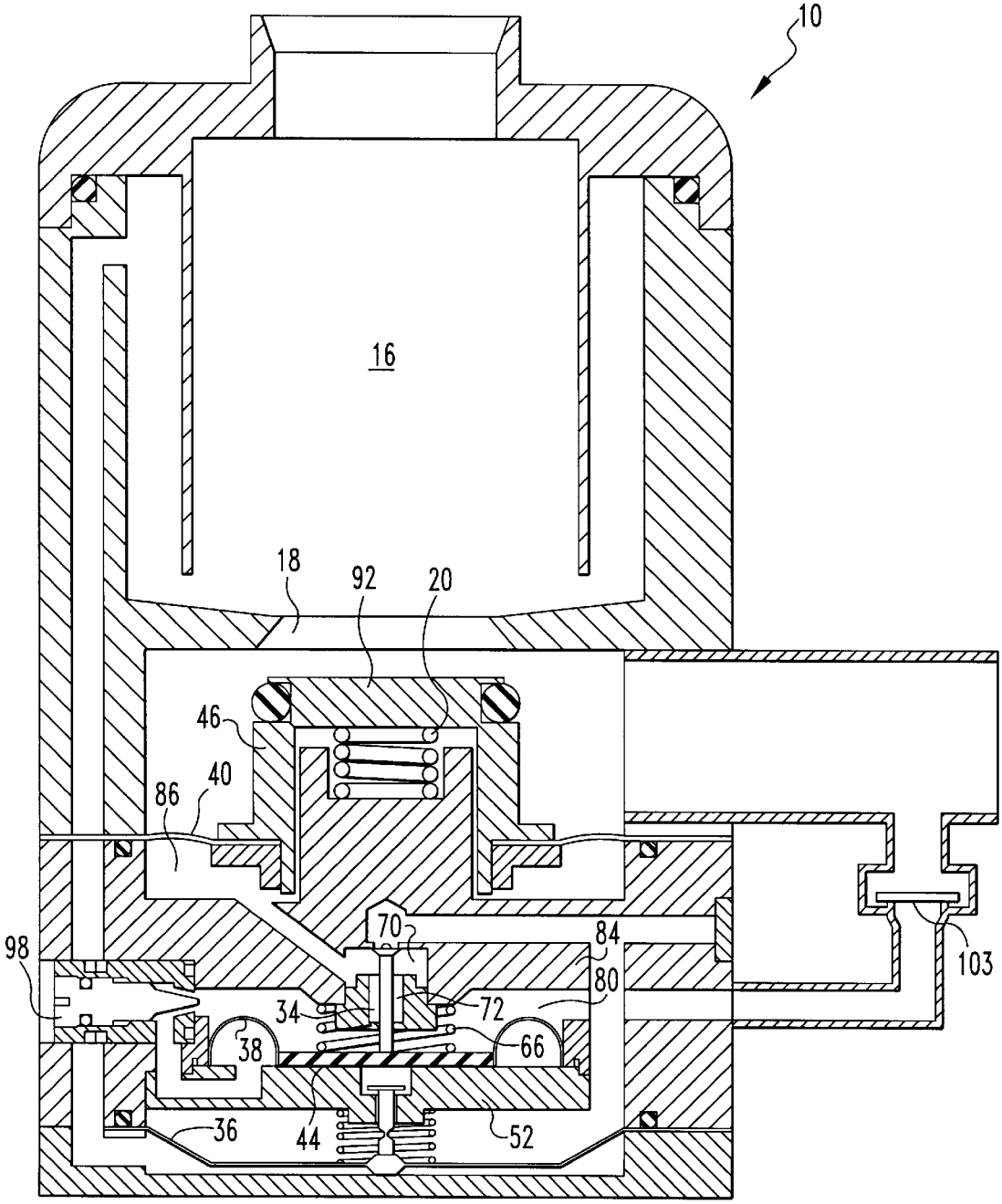
FIG. 6 is a schematic representation of the apparatus according to FIGS. 1 to 5 after a second valve has been switched back from its second to its first position.

If the pressure difference between the atmosphere transmitted to the first chamber 78 and the vacuum in the chamber 80 overcomes the force exerted by the spring 66 on the control diaphragm 38, the control diaphragm 38 is lifted (see FIG. 3). The piston 44, projecting from the control diaphragm 38, and its valve disc 74 is lifted from the bore 72 and closes an orifice 102 between the bore 76 to the opening 68 and the bore 96 to the chamber 86, which is hereafter addressed as second chamber and is confined by the actuating diaphragm 40. Therewith, the second chamber 86 is connected through the second valve 34 with the vacuum pipeline 22 and evacuated. The vacuum pressure in the second chamber 86 together with the gravity of the liquid collected in the sump 16 exert a force on the valve disc 92 and drive the valve piston 46 against the force of the spring 90 away from the orifice 18. The liquid in the sump 16 can now be evacuated through the open orifice 18 and the vacuum pipeline 22 (see FIG. 4).

When the liquid is evacuated, the hydrostatically generated air pressure transmitted from the ring chamber 28 through the bore 30 to the forth chamber 62 is released and the spring 56 can now return the sensor diaphragm 36 to its original position. The piston 42 of the first valve 32 closes the bore through the first separating wall 52 (see FIG. 5).

Depending on the adjustment of the throttling element 98, the first chamber 78 is evacuated more or less fast through the conduit 82 and the vacuum pipeline 22. The spring 66 located between the second separating wall 84 and the control diaphragm 38 can now return the control diaphragm 38 to its original position adjacent to the first separating wall 52. The bore 72 through the insert part 48, inserted in the second separating wall 84, is now closed by the piston 44 of the second valve 34. Atmospheric pressure is now transmitted into the second chamber 86 which is located between the actuating diaphragm 46 and the second separating wall 84. The atmospheric pressure in the second chamber 86 and the force of the spring 90 lift the piston 46, and the valve disc 92 of the third valve 20 can now close the orifice 18 of the sump 16. The means has now returned to the condition shown in FIG. 1.

The throttling element 98 acts as a timer element by delaying evacuation of the first chamber 78 and therewith closure of the third valve 20. During this delay time period, not only the liquid, but also air can be evacuated from the sump 16 to the vacuum pipeline 22.

A check valve element 103 may be provided in conduit 82 connecting the sixth chamber 80 and the vacuum pipeline 22 in order to prevent liquid entering the conduit 82.

Figure 8:
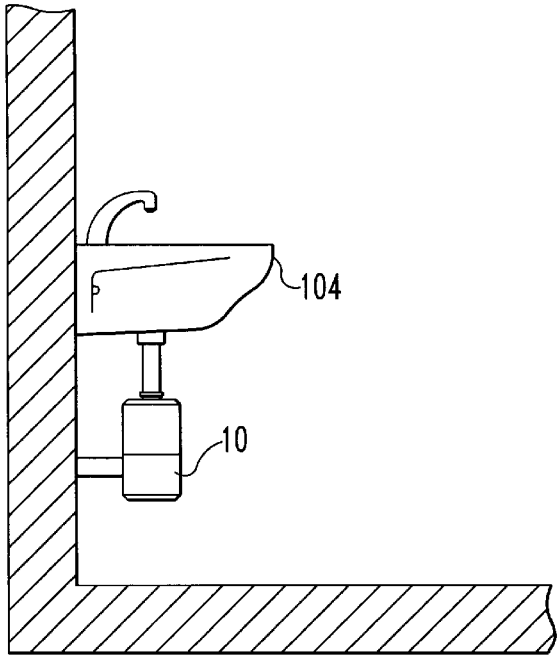
FIG. 8 is a schematic representation of a wash basin equipped with an apparatus according to the present invention.

As a result of the compact design of the apparatus 10, its housing 12 may have dimensions like common water syphons and replace those when used for wash basins 104 or urinals 106, as shown in FIGS. 8 and 9. External conduits which might be subject to damage are not required for any control or evacuation procedure.

Figure 7:
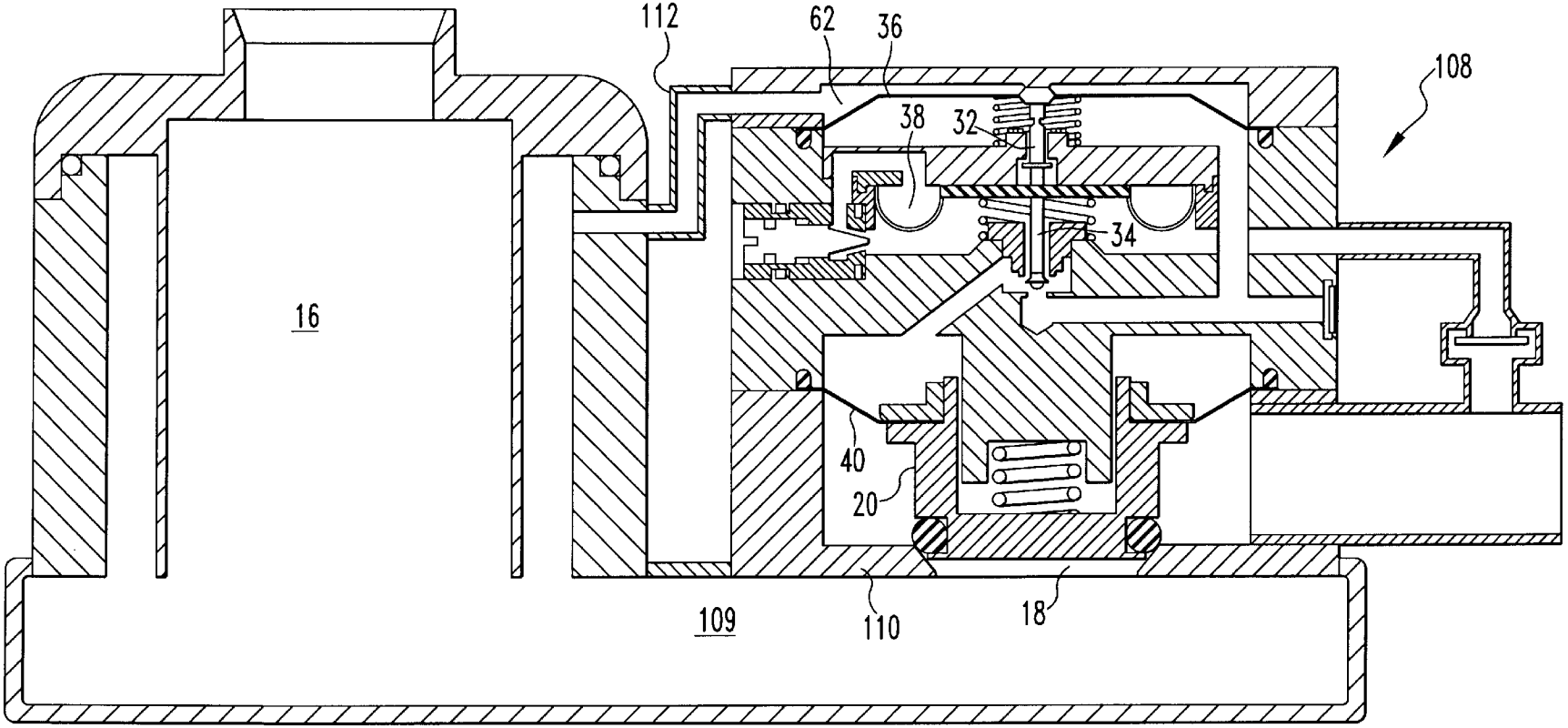
FIG. 7 is a schematic representation of the apparatus for evacuation of liquid from a bath or shower tub.

FIG. 7 shows an apparatus 108 which is identical to the apparatus 10 in FIGS. 1 to 6, with the exception that the sump 16 is connected through a rigid connection 109 with a housing 110 wherein the first, second and third valves 32, 34 and 20 as well as the diaphragms 36, 38 and 40, whose design and function is principally equal to that of those shown in FIGS. 1 to 6, are located along a common axis.

The liquid collected in the sump 16 and filling the connection 109 up to the orifice 18 which is closed by the valve 20 hydrostatically generates an air pressure which is transmitted through a conduit 112, such as a hose, to the chamber 62, which is confined by the sensor diaphragm 36, in order to start the described time controlled switching and evacuating procedures. The apparatus 108 is suited for installation underneath e.g. shower or bath tubs.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for evacuation of liquid from a sanitary appliance such as a wash basin, urinal, shower or bath tub disposed in a structure, into a vacuum sewerage system, comprising:

a housing adapted to be disposed in the structure in which the sanitary appliance is disposed, said housing in fluid connection with the sanitary appliance, said housing comprising:

a vacuum pipeline and a sump connected to the vacuum pipeline, said sump for collection of the liquid hydrostatically generating an air pressure for activation of control elements controlling the evacuation of the liquid from the sump through the vacuum pipeline;

a connection between the sump and vacuum pipeline;

a sensor diaphragm moveable by the hydrostatically generated pressure in communication with the sump;

a first valve in contact with the sensor diaphragm operated by movement of the sensor diaphragm;

a first chamber into which atmospheric pressure is transmittable through the opened first valve;

a control diaphragm which is located adjacent to the first chamber and moved as atmospheric pressure is transmitted into the first chamber;

a second valve in contact with the control diaphragm which is operated by movement of the control diaphragm;

a third valve which is opened as the second valve is switched from a first to a second position and opens or closes the connection between the sump and the vacuum pipeline, whereby the first valve and the second valve and the third valve are movable along a common axis;

an actuating diaphragm which is circumferentially connected with the housing;

a piston of the third valve which is connected with the center of the actuating diaphragm;

a second chamber located adjacent to the actuating diaphragm into which either atmospheric pressure or vacuum is transmittable, depending on the position of the second valve;

a third chamber which is separated from the second chamber by the actuating diaphragm, connected with the vacuum pipeline and connectable through the third valve with the sump; and whereby the sensor diaphragm, the control diaphragm, the first valve, the second valve and the third valve are all included in the housing.

2. An apparatus as described in claim 1 comprising a fourth chamber into which the hydrostatically generated pressure is transmittable from the sump, whereby the sump is enclosed by a separating wall, the wall having a lower end above a bottom of the sump and entrapping air in the fourth chamber when the liquid in the sump reaches the lower end of the separating wall.

3. An apparatus as described in claim 1 comprising a spring element underneath the third valve driving the third valve in an upward direction to close an orifice between the sump and the vacuum pipeline.

4. An apparatus for evacuation of liquid from sanitary appliances such as wash basins, urinals or bath and shower tubs, into a vacuum sewerage system, comprising:

a housing comprising:

a vacuum pipeline and a sump connected to the vacuum pipeline, said sump for collection of the liquid hydrostatically generating an air pressure for activation of control elements controlling the evacuation of the liquid from the sump through the vacuum pipeline;

a connection between the sump and vacuum pipeline;

a sensor diaphragm moveable by the hydrostatically generated pressure in communication with the sump;

a first valve in contact with the sensor diaphragm operated by movement of the sensor diaphragm;

a first chamber into which atmospheric pressure is transmittable through the opened first valve and in communication with the first chamber;

a control diaphragm which is located adjacent to the first chamber and moved as atmospheric pressure is transmitted into the first chamber;

a second valve in contact with the control diaphragm which is operated by movement of the control diaphragm;

a third valve which is opened as the second valve is switched from a first to a second position and opens or closes the connection between the sump and the vacuum pipeline;

an actuating diaphragm which is circumferentially connected with the housing;

a piston of the third valve which is connected with the center of the actuating diaphragm;

a second chamber located adjacent to the actuating diaphragm into which either atmospheric pressure or vacuum is transmittable, depending on the position of the second valve;

a third chamber which is separated from the second chamber by the actuating diaphragm, connected with the vacuum pipeline and connectable through the third valve with the sump; and whereby the first valve and the second valve and the third valve or their valve pistons are movable along a common axis.

5. An apparatus for evacuation of liquid from a sanitary appliance such as a wash basin, urinal, shower or bath tub disposed in a structure, into a vacuum sewerage system, comprising:

a single and compact casing, adapted to be disposed in said structure in which the sanitary appliance is disposed, said casing in fluid connection with the sanitary appliance, said casing integrally including:

a connection to a vacuum pipeline;

a sump connected to the sanitary appliance such that liquid from the sanitary appliance hydrostatically generates an air pressure in the sump for activation of control elements controlling evacuation of liquid from the sump to the vacuum pipeline;

a closeable orifice in a wall or bottom of the sump connecting the sump with the vacuum pipeline;

an interface valve normally closing said orifice, said interface valve comprising a plug being removable from said orifice for opening said connection to said vacuum pipeline.

6. An apparatus as described in claim 5 comprising a spring element driving said plug against said wall or bottom of the sump thereby closing said orifice.

7. An apparatus for evacuation of liquid from a sanitary appliance such as a wash basin, urinal, shower or bath tub disposed in a structure, into a vacuum sewerage system, comprising:

a sump being in liquid connection with said sanitary appliance and connectable through an orifice with a vacuum pipeline, whereby liquid discharged from said sanitary appliance entraps air in the sump and hydrostatically generates an air pressure;

control elements controlling evacuation of liquid from the sump to the vacuum pipeline, depending on the value of said hydrostatically generated air pressure, a compact casing adapted to be disposed in the structure in which the sanitary appliance is disposed and connected with the sump and the vacuum pipeline for evacuation of liquid, said casing integrally including:

a downstream chamber openly connected with said vacuum pipeline and connectable with the sump through an interface valve;

a plug of an interface valve normally closing said orifice, said plug being removable from said orifice for evacuation of liquid from the sump to the vacuum pipeline, said plug being located in the downstream chamber and driven by spring force towards the orifice;

an actuating diaphragm which is circumferentially connected with the casing and centrally connected with said plug; and an actuating chamber located adjacent to said actuating diaphragm into which either vacuum or atmospheric pressure is transmittable by said control elements.

8. An apparatus for evacuation of liquid from a sanitary appliance such as a wash basin, urinal, shower or bath tub being disposed in a structure, into a vacuum sewerage system, comprising:

a single and compact casing adapted to be disposed in said structure, connected with a vacuum pipeline and in fluid connection with said sanitary appliance, said casing integrally including:

a sump being in fluid connection with said sanitary appliance, wherein liquid discharged from said sanitary appliance entraps air and hydrostatically generates an air pressure;

an orifice in a wall or bottom of said sump connecting said sump to the vacuum pipeline for evacuation of said liquid;

an interface valve having a plug normally closing said orifice;

control elements opening said interface valve when a certain value of said air pressure generated in said sensor chamber is exceeded and for closing said interface valve when said air pressure drops after evacuation of said liquid, said control elements comprising:

a sensor diaphragm moveable by said hydrostatically generated air pressure in communication with the sump;

a control valve in contact with the sensor diaphragm and operated by movement of the sensor diaphragm, whereby the control valve and the interface valve are integral components of said casing.

9. An apparatus as described in claim 8 whereby the control valve and the interface valve are moveable within said casing in substantially parallel directions.

10. An apparatus as described in claim 8 whereby said casing has a cylindrical shape and a central axis whereby said control valve and said interface valve are movable parallel to said axis.

11. An apparatus as described in claim 10 whereby said control valve and said interface valve are moveable along said axis.

12. An apparatus as described in claim 8 whereby the casing also includes:

a control chamber into which atmospheric pressure is transmittable through said opened control valve;

a control diaphragm which is located adjacent to said control chamber and moved as atmospheric pressure is transmitted into said control chamber;

a three-way valve in contact with said control diaphragm and being operated by movement of the control diaphragm;

an actuating chamber into which either atmospheric pressure or vacuum is transmittable depending on the position of said three-way valve;

an actuating diaphragm located adjacent to said actuating chamber and circumferentially connected with said casing;

a downstream chamber openly connected with said vacuum pipeline and separated from the sump by said interface valve and from said actuating chamber by said actuating diaphragm; and a piston of said interface valve, which is connected with the center of said actuating diaphragm.

13. An apparatus as described in claim 12 whereby said interface valve comprises a plug within said downstream chamber and is opened against a spring force when vacuum is transmitted from the vacuum pipeline through the three-way valve into the actuating chamber and closed by the spring force when atmospheric air is transmitted through the three-way valve into the actuating chamber.

14. An apparatus as described in claim 12 whereby said piston of the interface valve is cylinder-shaped and encompasses a piston-shaped section of the casing for guidance.

15. An apparatus as described in claim 14 comprising a spring element which is encompassed by said piston and generates a force between the piston and the piston-shaped section of the casing.

16. An apparatus as described in claim 15 whereby:

said casing includes a sensor chamber into which said hydrostatically generated air pressure from the sump is transmittable;

said sump comprises a bottom and is encompassed by a separating wall, the separating wall having a lower end above the bottom of the sump; and liquid collected in said sump entraps air in the sensor chamber and generates said air pressure when the liquid in the sump reaches the lower end of the separating wall.

17. An apparatus as described in claim 16 comprising a ring chamber which is separated from the sump by the separating wall, connected with the sump below the lower end of the separating wall and connected with the sensor chamber above the lower end of the separating wall.

18. An apparatus as described in claim 16 whereby the casing includes an atmospheric chamber that is connected with the atmosphere and separated from the sensor diaphragm chamber by the sensor diaphragm.

19. An apparatus as described in claim 18 whereby the atmospheric chamber is connectable through the control valve with the control chamber, located adjacent to the control diaphragm, whereby atmospheric pressure is transmitted to the control chamber while the control valve is open and whereby the control chamber is evacuated while the control valve is closed.

20. An apparatus as described in claim 8 whereby the casing includes a throttling element between the control chamber and the vacuum pipeline for delayed evacuation of the control chamber while the control valve is closed.

21. An apparatus as described in claim 12 whereby the casing includes a vacuum chamber, separated from the control chamber by the control diaphragm, connected with the vacuum pipeline and connectable through the three-way valve with the actuating chamber located adjacent to the actuating diaphragm.

22. An apparatus as described in claim 21 whereby the casing has dimensions similar to conventional water syphons used for sanitary appliances in buildings.

23. An apparatus as described in claim 7 whereby the sump is located separate from the casing and connected through a connection with the orifice closeable by the interface valve, whereby a conduit transmits hydrostatically generated air pressure from the sump to the control elements.

24. An apparatus as described in claim 7 whereby said casing comprises a wall and a bore within said wall extending parallel to a surface of the wall, the bore transmitting hydrostatically generated air pressure from the sump to control elements.

25. An apparatus for evacuation of liquid from a sanitary appliance, such as a wash basin, urinal, shower or bath tub, into a vacuum sewerage system, comprising a compact, piston-shaped casing with two plan circular surfaces and an axis, the casing integrally including:

a sump which is connected with said sanitary appliance through one of said plan surfaces;

a connection between the sump and a vacuum pipeline;

an interface valve normally closing said connection; and control elements controlling evacuation of the liquid from the sump through the interface valve and the vacuum pipeline.

26. An apparatus as described in claim 25 whereby said interface valve is movable along the axis of said casing.

27. A method for evacuation of liquid from a sanitary appliance into a vacuum pipeline comprising the steps of:

discharging the liquid from the sanitary appliance to a sump, thereby entrapping air and generating an air pressure in the sump;

transmitting the air pressure from the sump to pneumatic control elements; and removing a plug from an orifice within a bottom or wall of the sump and thereby opening a connection between the sump and the vacuum pipeline.

28. A system for removal of liquid comprising:

a sanitary appliance;

an evacuation apparatus being in fluid connection with said sanitary appliance and consisting of a single compact casing integrally including a sump, a plug normally closing an orifice in a wall or bottom of the sump, and a pneumatically operating control mechanism moving said plug from or to the orifice, said sump and said control mechanism together being contained within said compact casing; and a vacuum pipeline mechanism connected to the evacuation apparatus through which liquid from the sump is evacuated.

29. A system as described in claim 28 included in a structure wherein said sanitary appliance and said evacuation apparatus are located and connected, the evacuation apparatus being adapted to be disposed in said structure and having a piston-shape and dimensions similar to conventional water syphons used for sanitary appliances in houses.

30. An apparatus for evacuation of liquid from a sanitary appliance such as a wash basin, urinal, shower or bath tub disposed in a structure, into a vacuum sewerage system, comprising:

a housing adapted to be disposed in the structure in which the sanitary appliance is disposed, said housing in fluid connection with the sanitary appliance, said housing comprising:

a sump connected to a vacuum pipeline, liquid discharged from the sanitary appliance hydrostatically generating an air pressure in the sump for activation of control elements controlling the evacuation of the liquid from the sump through the vacuum pipeline, said sump having an orifice in a wall or bottom of the sump connecting the sump and the vacuum pipeline and being closable by a third valve;

a sensor diaphragm moveable by the hydrostatically generated pressure in communication with the sump;

a first valve in contact with the sensor diaphragm operated by movement of the sensor diaphragm;

a first chamber into which atmospheric pressure is transmittable through the opened first valve;

a control diaphragm which is located adjacent to the first chamber and moved as atmospheric pressure is transmitted into the first chamber;

a second valve in contact with the control diaphragm which is operated by movement of the control diaphragm;

a third valve which is opened as the second valve is switched from a first to a second position and opens or closes the orifice of the sump and the vacuum pipeline;

an actuating diaphragm which is circumferentially connected with the housing;

a piston of the third valve which is connected with the center of the actuating diaphragm;

a second chamber located adjacent to the actuating diaphragm into which either atmospheric pressure or vacuum is transmittable, depending on the position of the second valve;

a third chamber which is separated from the second chamber by the actuating diaphragm, connected with the vacuum pipeline and connectable through the third valve with the sump; and whereby the sensor diaphragm, the control diaphragm, the first valve, the second valve and the third valve are all included in the housing.

* * * * *